United States Patent [19]

MacLeod, Jr.

[11] Patent Number: 4,565,495

[45] Date of Patent: Jan. 21, 1986

[54] ARMORING SYSTEM FOR AN AIRFOIL CENTRIFUGAL FAN

[75] Inventor: Donald R. MacLeod, Jr., Hingham, Mass.

[73] Assignee: Electric Power Research Institute, Inc., Palo Alto, Calif.

[21] Appl. No.: 522,639

[22] Filed: Aug. 11, 1983

[51] Int. Cl.[4] ..... F04D 29/30

[52] U.S. Cl. ..... 416/224; 416/184; 416/233

[58] Field of Search ..... 416/224, 184, 233; 411/537, 538, 222

[56] References Cited

U.S. PATENT DOCUMENTS

| | | | |
|---|---|---|---|
| 1,785,543 | 12/1930 | Dornier | 416/233 X |
| 1,985,705 | 12/1934 | Whiton | 416/224 X |
| 2,389,760 | 11/1945 | Brierley | 416/224 |
| 2,653,755 | 9/1953 | Kruhmin | 416/134 |
| 3,220,289 | 11/1965 | Farekas | 411/537 X |
| 3,263,963 | 8/1966 | Hanschke et al. | 416/224 X |
| 3,289,297 | 12/1966 | Casselman et al. | 411/222 X |
| 3,398,883 | 8/1968 | Ariewitz | 416/224 |
| 3,426,965 | 2/1969 | Kulling | 416/184 X |
| 3,856,434 | 12/1974 | Hoffmann | 416/224 |
| 4,318,672 | 3/1982 | Hansen | 416/224 |
| 4,324,529 | 4/1982 | Nickels | 416/224 X |

FOREIGN PATENT DOCUMENTS

| | | | |
|---|---|---|---|
| 1192949 | 10/1959 | France | 416/224 |
| 22604 | 3/1978 | Japan | 416/184 |
| 656336 | 8/1951 | United Kingdom | 416/224 |
| 2039630 | 8/1980 | United Kingdom | 416/224 |
| 767388 | 9/1980 | U.S.S.R. | 416/224 |

*Primary Examiner*—Everette A. Powell, Jr.

*Attorney, Agent, or Firm*—Flehr, Hohbach, Test, Albritton & Herbert

[57] ABSTRACT

An armoring system for use with an airfoil centrifugal fan for preventing erosion of the airfoil blades of the fan. The armoring system comprises an armor shield adapted to be releasably secured to at least a portion of the upper surface of the fan blades to prevent erosion thereof. The armoring system further includes mounting means cooperating with the armor shield for releasably securing the armor shield to the blades. The mounting means are positionable within the hollow space formed by the upper and lower surfaces of the blades to structurally reinforce the blades without altering their aerodynamic shape.

16 Claims, 5 Drawing Figures

FIG.—1
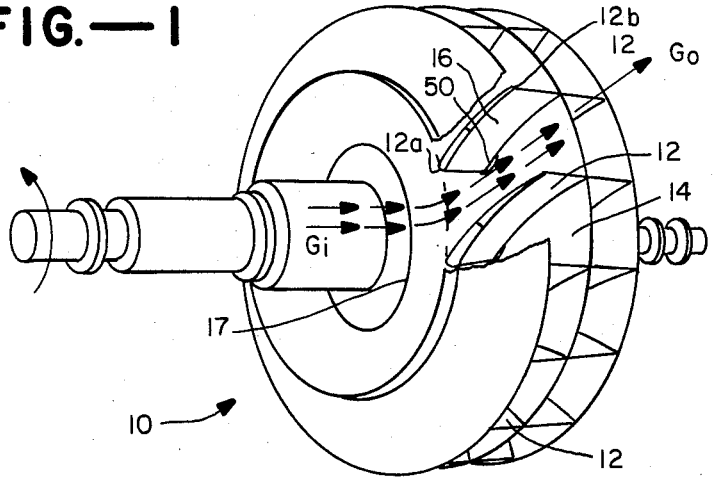
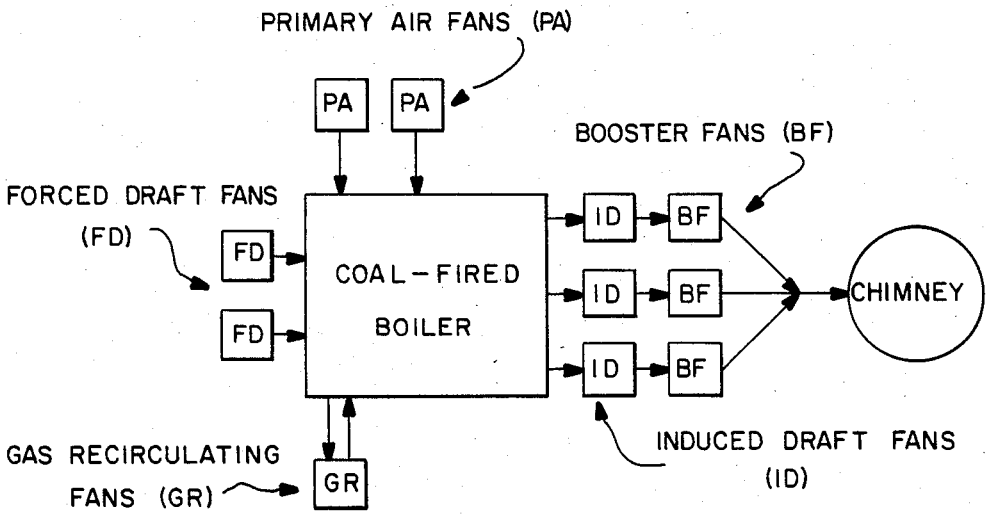
FIG.—2
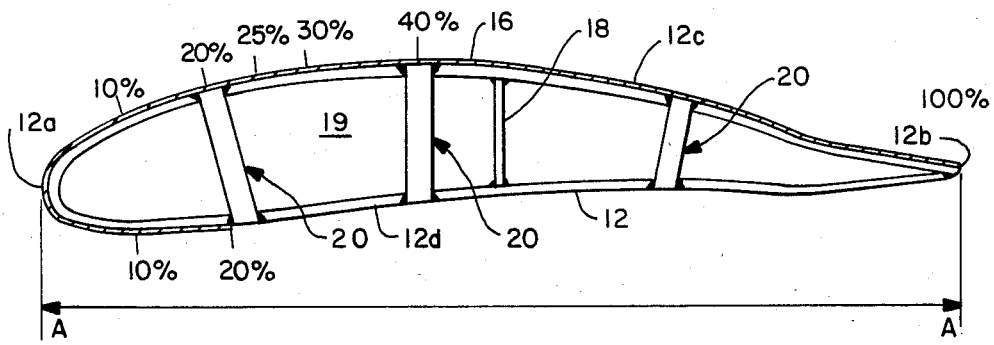
FIG.—3

ARMORING SYSTEM FOR AN AIRFOIL CENTRIFUGAL FAN

The present invention relates generally to systems for preventing erosion damage to power plant fans, and more particularly, to an armoring system for preventing erosion of the airfoil fan blades of an airfoil centrifugal fan.

Coal-burning power plants are fueled by bituminous coals, subbituminous coals and lignites. Each of these fuels produce fly-ash particles which can severely erode fans used in a power plant. The susceptibility of a fan to fly-ash erosion damage is dependent upon, among other things, the manner in which the fan is used in the plant. A typical coal-burning plant utilizes a number of fans for various applications. For instance, forced-draft fans supply combustion air and push hot gases through the coal-fired boiler. Primary air fans inject pulverized coal into the boiler's furnace compartment. Gas recirculating fans control the output of the boiler. Induced draft fans pull hot, dirty gases from the boiler, and booster fans push these gases through air pollution control equipment. The primary air and forced-draft fans see relatively clean outside air while the gas recirculating, booster, and induced draft fans are exposed to combustion gases produced in the boiler. The combustion gases are laden with fly-ash particles, and as expected, the fans exposed to these gases are the most susceptible to the erosive action of fly-ash.

As measured by the cost of repairs of fly-ash erosion damage and the cost of purchasing replacement power while a plant is shut down for repairs, induced-draft fans are the most troublesome for the utility industry. Three different types of induced draft fans are commonly used: the variable pitch axial fan, the radial tip centrifugal fan, and the airfoil centrifugal fan. The airfoil centrifugal fan, to which the present invention is directed, comprises a plurality airfoil blades having upper and lower surfaces defining an inner, void space therebetween. The airfoil blades over which the incoming gases pass are particularly subject to attack by the fly-ash particles entrained in the gases.

An approach used heretofore for reducing the erosion of airfoil blades involves the use of wear plates, which are simply steel deck plates, welded to the exterior surface of each blade. The fly-ash particles thus erode the wear plates rather than the fan blades; accordingly, damage to the fan is reduced. However, this approach is undesirable for a number of reasons. First, the additional weight added to the fan blade by the wear plate increases the centrifugal force imposed on the blade during operation of the fan, which significantly increases the likelihood of blade failure. Additionally, when the wear plates have to be replaced, it is a very time-consuming and expensive procedure to remove them as they are welded to the blades.

The utility industry has also experimented with various metalizing processes wherein the wear plates are coated with an erosion-resistant coating such as tungsten carbide, a chrome plating or a high chromium iron weld overlay. Although this technique is an improvement over the use of steel deck plates, it suffers from the same drawbacks in that the wear plates carrying the erosion-resistant coating are welded to the exterior surfaces of the blades. Thus, the repair costs are significant, if not prohibitive, and the possibility of structural failure of the blades is enhanced.

The present invention eliminates the major disadvantages associated with the above-described erosion-preventive techniques. With the armoring system of the present invention, the armor shield is not welded to the airfoil blades but rather is removably secured thereto so that the shield may be removed without incurring exorbitant repair costs. Additionally, the means by which the armor shield of the present invention is secured to the airfoil blades structurally reinforces the blades so that the blades are able to withstand the additional centrifugal force imposed thereon by the weight of the armor shield. Further, the aerodynamic shape of the blades and thus the efficiency of the fan is not effected by the armoring system of the present invention.

Accordingly, an object of the present invention is to provide an improved armoring system for reducing erosion damage to the airfoil blades of an airfoil centrifugal fan.

A more specific object of the present invention is to provide an improved armoring system wherein an armor shield is releasably mounted on the airfoil fan blades in a manner which structurally reinforces the blades but which does not effect the aerodynamic shape of the blades.

According to the present invention, an improved armoring system for use with an airfoil centrifugal fan for preventing erosion of the blades thereof is provided. The armoring system includes an armor shield which is adapted to be releasably mounted to the exterior of each blade about at least a portion of the upper surface thereof to prevent erosion of the blade. A mounting means is adapted to cooperate with the armor shield for releasably mounting the shield to the blade. The mounting means is positionable within the interior void space defined by the upper and lower surfaces of the blade so as to maintain the aerodynamic shape of the blade. The mounting means also structurally reinforces the blade so that the blade is able to resist the centrifugal force imposed thereon.

The mounting means may comprise a plurality of support columns spaced about the interior, void space defined by the upper and lower surfaces of the blade to extend therebetween and to be affixed thereto. A threaded member may extend through respective holes in the armor shield and the exterior surfaces of the blade and into the support column for releasably mounting the shield on the blade. A means for reducing side loading on the threaded member due to an axial or radial offset between the holes in which the threaded member is positioned may also be provided. Additionally, means for disengagably engaging the threaded member may be provided to secure the threaded member in the support column to releasably secure the armor shield to the blade.

The present invention will be described in more detail hereinafter in conjunction with the drawings wherein:

FIG. 1 is a schematic view, partly broken away, illustrating an airfoil centrifugal fan;

FIG. 2 is a schematic, block diagram which illustrates the fans used in a typical coal-burning electrical power plant;

FIG. 3 is a schematic side view which shows an airfoil blade of an airfoil centrifugal fan with the armoring system of the present invention incorporated therewith;

Figure 4:
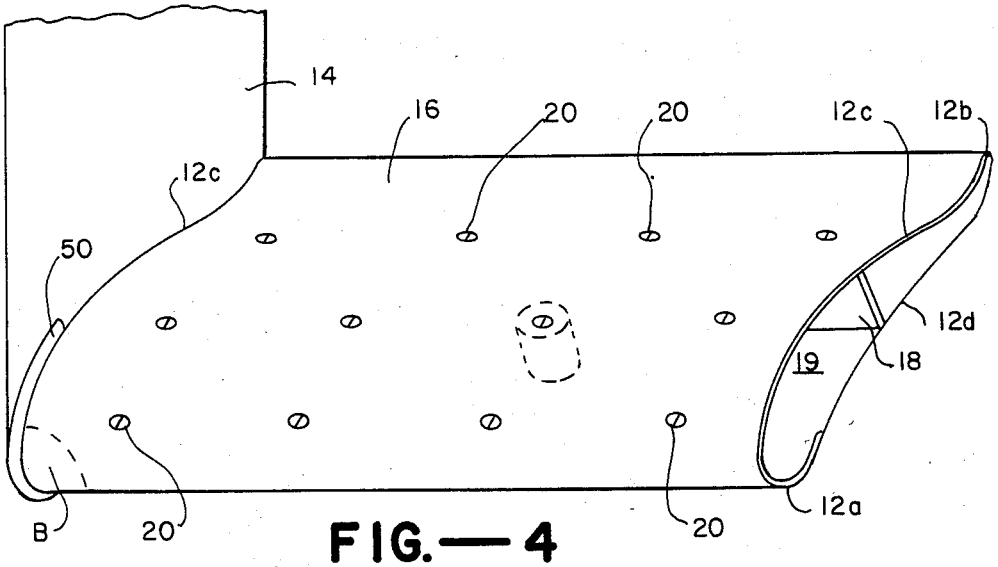
FIG. 4 is a schematic view which shows an airfoil blade having the armor shield of the armoring system of the present invention releasably mounted thereon.

Referring now to the drawings, attention is first directed to FIG. 1 which shows an airfoil centrifugal fan 10 having airfoil blades 12 joined on one side thereof to a fan centerplate 14 which in turn is attached to a fan hub 17. For purposes of the present discussion, it will be assumed that fan 10 is to be used as an induced-draft fan in a coal-burning power plant (see FIG. 2). As discussed hereinabove, induced-draft fans are most prone to damage by gas-entrained fly-ash particles as these fans are used to pull hot, dirty gases from the coal-fired boiler. Airfoil centrifugal fans are commonly used at such locations as they have a very high resistance to fly-ash erosion damage, at least so long as the fly-ash particles do not penetrate the surfaces of the blades. The armoring system of the present invention may be used with any airfoil centrifugal fan regardless of the fan's particular application. The present invention, however, is particularly suited for use with those airfoil centrifugal fans used in coal-fired power plants wherein the fans are exposed to extensive bombardment by fly-ash particles. For example, in addition to induced-draft fans, the present invention may be used with airfoil centrifugal fans which function as gas recirculating fans for controlling boiler output (see FIG. 2).

The gas flow through fan 10 is illustrated by arrows $G_i$ (gas in) and $G_o$ (gas out). The path of the gas flow is across blades 12 from the nose or leading edge 12*a* thereof to the trailing edge 12*b*. As shown in FIG. 3, each blade 12 comprises an upper or pressure surface 12*c* and a lower or suction surface 12*d*, defining an interior, void space 19 therebetween. The blade includes a rib or support member 18 extending between the upper and lower surfaces. The fly-ash particles carried by gas stream $G_i$–$G_o$ will impinge on airfoil blades 12 and other parts of fan 10 to cause erosion damage unless an appropriate erosion-preventative system is incorporated in the fan.

The degree of damage to the blades is dependent upon the angle, velocity, distribution, chemical properties, and size of the fly-ash particles bombarding the blades. The greatest erosion damage can be expected to occur at the leading edge of the blade near the junction of the blade and the fan centerplate. However, the other surfaces of the blade are also subject to attack, and if the gas stream $G_i$–$G_o$ contains a significant concentration of relatively large particles, that is, particles larger than 200 microns, an extensive amount of erosion damage can be expected along upper surface 12*c* from leading edge 12*a* to trailing edge 12*b*. Accordingly, it is imperative the blade surfaces be protected from the erosion fly-ash particles.

Figure 5:
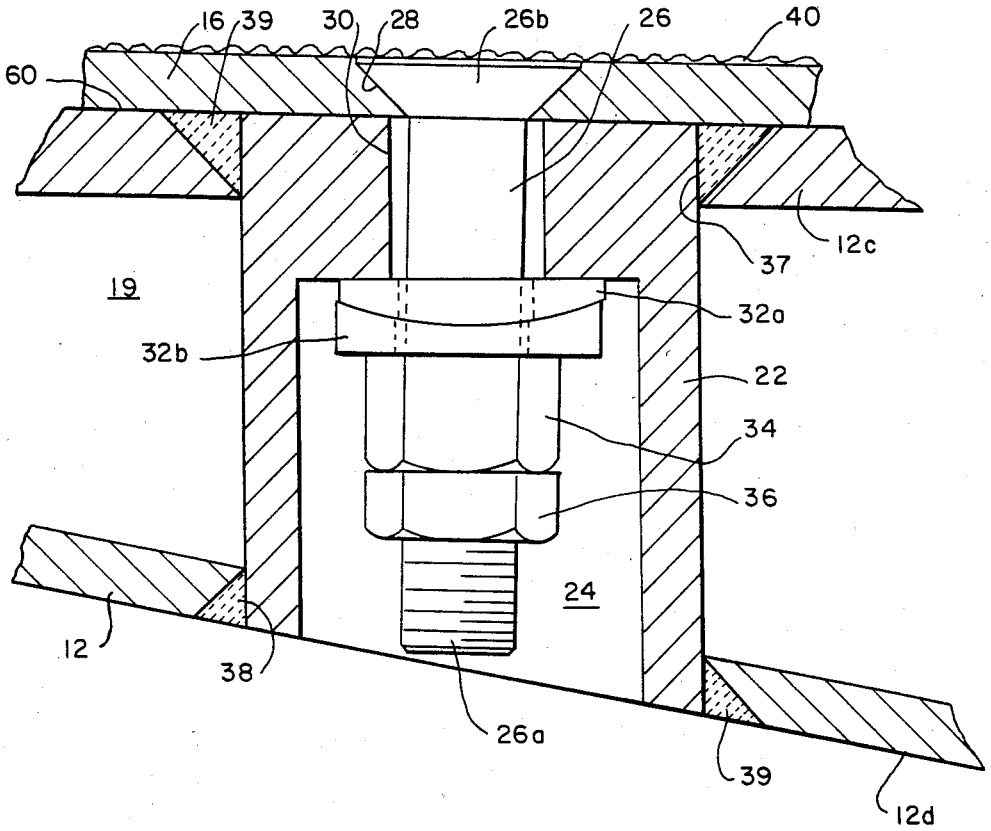
FIG. 5 is a schematic view which illustrates the mounting means for releasably mounting the armor shield of the armoring system of the present invention to an airfoil blade.

The armoring system of the present invention is illustrated in detail in FIGS. 3–5. In the particular embodiment shown, an armor shield 16 covers the entire upper surface of each blade 12 and extends around leading edge 12*a* to cover a portion of the blade's lower surface 12*d*. If the chord length of blade 12 is represented by line A—A, then as shown in FIG. 3, the armor shield covers 20% of the median arc length on lower surface 12*d*. Of course, armor shield 16 may be adapted to cover less than the entire upper surface 12*c* of the blade, or to cover more or less than 20% of the median arc length on lower surface 12*d*. In this respect, FIG. 3 is marked with various median arc length percentages on both the blade's upper and lower surfaces to indicate additional armor sizes. An armor shield extending from 10% on the lower surface of the blade to 10% on the upper surface of the blade would be ideal for protecting a blade where most of the erosion damage is expected to occur at the blade's leading edge.

The particular embodiment shown in FIGS. 3 and 4 provides the most protection; however, the weight added to the blade by the armor shield is a major disadvantage as it increases the centrifugal force imposed on the blade, which increases the likelihood of blade fatigue. It if it assumed that armor shield 16 is a 0.125 inch thick stainless steel plate and that the diameter of the fan wheel is 154 inches, the weight added to each blade increases from approximately 17 lbs. when 10% of the blade's upper surface is covered to approximately 90 lbs. when the entire upper surface is covered. The additional centrifugal force imposed on each blade at 100 rpm increases from 27,000 lbs. for the 10% coverage to 152,000 lbs. for the 100% coverage—a substantial increase in the force which the blade must withstand.

Armor shield 16 is releasably secured to each blade 12 by a mounting means generally indicated at 20. Mounting means 20 is adapted to structurally reinforce the blade so that the blade is able to resist the additional centrifugal force imposed thereon by the weight of the armor shield. The mounting means secures the armor shield to the blade in a manner which does not alter the aerodynamic shape of the blade and which accommodates the varying profile (from leading to trailing edge) of the blade. As can be seen from FIG. 4, a plurality of mounting means 20 are used to removably secure armor shield 16 to upper surface 12*c* of blade 12. Additional mounting means, such as illustrated in FIG. 3, releasably secure the armor shield to lower surface 12*d*.

Mounting means 20 is shown in greater detail in FIG. 5. In the preferred embodiment, the mounting means comprises a support column or structural stiffener 22, preferably cylindrical in shape, having a counterbore or recessed area 24 formed therein. The cylindrical support column is located in interior void, space 19 formed by the upper and lower surfaces of the blade to extend therebetween. The support column may be welded or otherwise appropriately affixed at its respective ends to the upper and lower surfaces of the blade. As shown in FIG. 3, support column 22 is located within countersunk holes 37 and 38 formed, respectively, in the upper and lower surfaces of the blade. A weld 39 secures support column 22 to the upper and lower blade surfaces. The weld forms a seal between support column 22 and the respective countersunk holes to prevent fly-ash particles from entering void space 19. In this manner, support column 22 structurally stiffens the blade to support the centrifugal force imposed thereon by the blade's weight and by the weight of the armor shield. As each blade is structurally reinforced, the structural integrity of the fan is enhanced.

Mounting means 20 further includes a flat head screw or bolt 26 having threads 26*a* formed at one end thereof. A countersunk head 26*b* is formed at the other end of threaded member 26. Threaded member 26 is adapted to extend through a countersunk hole 28 in shield 16 and a respective hole 30 in upper surface 12*c* of blade 12. Countersunk head 26*b* seats within countersunk hole 28 with the threaded member extending into recessed area 24 of support column 22. Where armor shield 16 is attached to the blade's lower surface, holes like that of hole 30 in upper surface 12*c* are formed in lower surface 12*d* for securing the armor shield to that surface.

The mounting means further includes spherical washers 32*a* and 32*b* located within recessed area 24 to engage threaded member 26. The spherical washers are used to accommodate any axial or radial offset between mated holes 28 and 30. The spherical washers assure that countersunk head 26*b* of threaded member 26 is in complete contact with countersunk hole 28 and that the threaded member is stressed in pure tension with no side loading imposed thereon because of any offset between holes 28 and 30. The spherical washers eliminate the need for a close tolerance in the location of hole 28 with respect to its mated or respective hole 30. Additionally, the spherical washers do away with the necessity of having to plug old holes and redrill the blade surfaces each time the armor shield is replaced. Also located within recessed area 24 of support column 22 is a threaded locking arrangement for engaging threaded member 26. The threaded locking arrangement comprises a hexagonal nut 34 for engaging the threaded end of the threaded member to secure the threaded member in the support column thereby releasably securing armor shield 16 to the exterior surface of the blade. A lock nut 36 is also provided to releasably lock hexagonal nut 34 to threaded member 26.

Armor shield 16 may have a number of different configurations. For example, as noted above, armor shield 16 may comprise a 0.125 inch stainless steel plate. Armor shield 16 may also comprise a 0.0625 inch steel substrate electroplated with a hard chrome to a thickness of 0.030 of an inch. Yet another configuration for armor plate 16 would be the use of a high chromium iron weld overlay on a 0.0625 inch steel substrate. The hard chrome and high chromium iron overlay are both erosion-resistant coatings which are more durable and hence have a longer life than an uncoated steel plate.

A hard facing 40, such as chrome-carbide weld metal, may also be applied to the outer surface of armor plate 16 to provide additional erosion protection. To remove armor plate 16 from blade 12, hard facing 40 is burned off in the area of countersunk head 26*b* and each threaded member 26 is unscrewed and removed from support column 22. The armoring system of the present invention thus may be replaced relatively quickly, reducing the repair costs associated with an armoring system for preventing erosion damage to airfoil centrifugal fan blades.

As can be seen from FIG. 4, a plurality of mounting means 20 are used to releasably secure the protective armor shield to the exterior surfaces of the blade. The mounting means are spaced about the interior, void space 19 defined by the upper and lower surfaces of the blade in the region of the blade where armor shield 16 is secured. Location of mounting means 20 is critical, as the centrifugal force imposed on the armor shield is transmitted to the blade through the mounting means. An area of high stress concentration has been found to exist in the corner of the blade near the junction of leading edge 12*a* and centerplate 14. This area is shown bounded by dotted lines in FIG. 4 and is designated with the letter "B". To prevent failure of the blade, it is very important that area "B" not be drilled or have a mounting member located therein.

Referring back to FIGS. 1 and 4, an additional feature which can be incorporated into the armoring system of the present invention is a horseshoe-shaped stainless steel plate 50 for preventing erosion damage to fan centerplate 14. Plate 50 is welded to armor shield 16. Plate 50 does not have to be directly attached to centerplate 14.

A sealant, which is indicated generally at 60, may also be incorporated into the system of the present invention. Sealant 60, see FIG. 5, is applied between the edge of armor shield 16 and the exterior surfaces of the blade to prevent fly-ash particles from entering any gaps therebetween. A silicone sealant may be used, and it can be applied with a caulking gun.

Although the invention has been described with reference to a specific embodiment, the description is illustrative of the invention and is not to be considered as limiting the invention in any way. Various modifications and applications may occur to those skilled in the art without departing from the true spirit and scope of the invention as defined by the appended claims.

What is claimed is:

1. An armoring system for use with an airfoil centrifugal fan for preventing erosion of the airfoil blades of the fan wherein the upper and lower surfaces of each blade define an interior, void space therebetween, comprising:

an armor shield adapted to be releasably secured to the exterior of each blade about at least a portion of the upper surface thereof for preventing erosion of said portion of the blade;

a plurality of support columns adapted to be spaced about the interior, void space formed by the upper and lower surfaces of the blade in the region of the blade to which said armor shield is adapted to be releasably secured, said support columns to be affixed at their respective ends to the upper and lower surfaces of the blade to structurally reinforce the blade;

a threaded member adapted to extend through respective holes in said armor shield and said portion of the blade to which said armor shield is to be releasably secured and into an opening formed in a respective one of said support columns for releasably securing said armor shield to said portion of the blade, said threaded member not extending beyond the upper and lower surfaces of the blade;

means for reducing side loading on said threaded member due to an axial or radial offset between said respective holes in said armor shield and said portion of the blade; and means for disengagably engaging said threaded member to secure said threaded member in said support column to releasably secure said armor shield to said portion of the blade.

2. The armoring system of claim 1 wherein said holes in said armor shield are countersunk and said threaded member has a countersunk head formed at one end thereof to seat within said countersunk holes.

3. The armoring system of claim 2 wherein said side loading reducing means is a spherical washer.

4. The armoring system of claim 3 further including means for releasably locking said disengagably engaging means to said threaded member.

5. The armoring system of claim 4 wherein said disengagably engaging means is a hexagonal nut and said locking means is a lock nut both of which are mated to said threaded member to secure said threaded member by the application of a torque thereto.

6. The armoring system of claim 1 wherein said armor shield covers the entire upper surface of the blade and extends around the leading edge thereof to cover at least a portion of the lower surface of the blade.

7. The armoring system of claim 1 wherein said armor shield is a metal plate having an erosion resistant coating thereon.

8. The armoring system of claim 1 wherein said support columns are cylindrical in shape and are secured at their respective ends in countersunk holes formed in the upper and lower surfaces of the blade.

9. The armoring system of claim 8 further including means for sealing said support columns within said countersunk holes to prevent entrainment of erosive particles within the interior, void space.

10. An armoring system for use with an airfoil centrifugal fan for preventing fly-ash erosion of the airfoil blades of the fan wherein the upper and lower surfaces of each blade define an inner, void space therebetween, comprising:

an armor shield releasably secured to the exterior of each blade about at least a portion of the upper and lower surfaces of the blade to extend around the leading edge thereof to prevent erosion of said portion of the blade;

a plurality of rigid, cylindrical columns positioned within the inner, void space formed by the upper and lower surfaces of the blade and extending between and affixed at the respective ends thereof to the upper and lower surfaces of the blade to structurally reinforce the blade;

a cylindrical member having threads at one end thereof and a countersunk head at the opposite end, said member extending through a countersunk hole in said armor shield and a respective hole substantially aligned with said countersunk hole in said portion of the blade to which said armor shield is secured, and into a recessed area in said support column wherein said countersunk head is seated within said countersunk hole such that no part of said cylindrical member extends beyond the upper and lower surfaces of the blade;

means within said recessed area for engaging said threaded member to reduce side loading imposed thereon by an axial or radial offset between said countersunk hole and said respective hole;

means having a central threaded opening formed therein for disengagably engaging the threads of said threaded member to secure said threaded member in said support column to thereby releasably secure said armor shield to said portion of the blade; and means for releasably locking said centrally threaded means to said threaded member.

11. The armoring system of claim 10 wherein said side loading reducing means is a spherical washer.

12. The armoring system of claim 11 wherein said disengagably engaging means is a hexagonal nut and said locking means is a lock nut both of which are mated to said threaded member to secure said threaded member by the application of a torque thereto.

13. The armoring system of claim 12 wherein said armor shield extends from the trailing edge of the blade to cover the entire upper surface thereof and around the leading edge of the blade to extend to twenty percent on the median arc length on the lower surface of the blade.

14. The armoring system of claim 13 further including a substantially horseshoe-shaped member affixed to that side of said armor shield at the junction of the blade and centerplate of the fan near the leading edge of the blade to prevent erosion of said centerplate.

15. The armoring system of claim 13 wherein said armor shield is a metal plate having an erosion resistant coating thereon.

16. The armoring system of claim 10 wherein said armor shield extends from the trailing edge of the blade to cover the entire upper surface thereof and around the leading edge of the blade to extend to twenty percent on the median arc length on the lower surface of the blade.

* * * * *